United States Patent [19]

Matrak et al.

[11] Patent Number: 4,986,153

[45] Date of Patent: Jan. 22, 1991

[54] METHOD AND APPARATUS FOR THE PARTING AND REMOVAL OF PIECES FROM PUNCH PRESSES

[75] Inventors: Edgard Matrak, Tonawanda; Robert L. Hess, Clarence, both of N.Y.

[73] Assignee: Strippit Inc., Akron, N.Y.

[21] Appl. No.: 402,887

[22] Filed: Sep. 5, 1989

[51] Int. Cl.[5] ..... B26D 7/18

[52] U.S. Cl. ..... 83/25; 83/103; 83/157; 83/552; 83/571; 83/916

[58] Field of Search ..... 83/23, 25, 27, 103, 83/104, 552, 108, 142, 157, 571, 916, 143; 439/259; 285/31

[56] References Cited

U.S. PATENT DOCUMENTS

| | | | |
|---|---|---|---|
| 2,006,828 | 6/1933 | Flynt | 285/31 |
| 2,814,790 | 11/1957 | Stoll et al. | 439/259 X |
| 3,527,130 | 9/1970 | Krehans | 83/552 X |
| 4,030,391 | 6/1977 | Swanson et al. | 83/137 |
| 4,096,774 | 6/1978 | Kaufmann | 83/552 |
| 4,126,068 | 11/1978 | Brömer | 83/916 X |
| 4,261,237 | 4/1981 | Didonate, Jr. et al. | 83/139 |
| 4,452,115 | 6/1984 | Bredow | 83/552 X |
| 4,507,995 | 4/1985 | Bredow | 83/153 |
| 4,546,683 | 10/1985 | Völkel et al. | 83/27 |
| 4,658,688 | 4/1987 | Shah et al. | 83/552 |
| 4,787,282 | 11/1988 | Okachi et al. | 83/25 |

OTHER PUBLICATIONS

Brochure for Strippit-Houdaille Sem-Automatic Fabriactor Hole Punching Machine ©1980.

Brochure for Strippit-Houdaille Strippit CAP-1000 Turret Hole Punching Machine ©1983.

*Primary Examiner*—Frank T. Yost

*Assistant Examiner*—Kenneth E. Peterson

*Attorney, Agent, or Firm*—Hill, Van Santen, Steadman & Simpson

[57] ABSTRACT

A punch press, of the type capable of producing a piece from a sheet of material, the piece being attached to the sheet by a tab, is provided with a separation assembly that fits into a standard tool station. The invention provides for parting of the piece from the sheet, and automatic transport of the parted piece to a position overlying a hinged drop door provided as part of a removal assembly. The invention eliminates the need for manual parting and removal of the piece from the punch press.

16 Claims, 4 Drawing Sheets

11
12

III
10
20
14
IV
16
III
18
IV 26
24
28
22
19

58
34
VI
56
VI
46
48
30

METHOD AND APPARATUS FOR THE PARTING AND REMOVAL OF PIECES FROM PUNCH PRESSES

TECHNICAL FIELD

This invention relates generally to punch presses, and more specifically to parting a piece from a sheet of material from which it was formed, and removing the parted piece from a punch press.

BACKGROUND OF THE INVENTION

It is known to provide a multi-tool punch press to automatically bring into alignment respective punches and dies for punching a variety of holes into a sheet material. The pieces of metal punched out to form these holes drop through the dies and are collected, either for scrap or for subsequent use. However, when the piece (or hole) desired is larger than can be formed in one stroke of a punch, a small punch is used to make a series of holes around the perimeter of the desired shape. This process is referred to as "nibbling". It is common practice to leave parts formed by nibbling attached to the sheet by tabs. When all punching on that particular sheet has been completed, the press operator removes the pieces from the sheet manually. Such manual removal is time-consuming and labor-intensive, and thus is also expensive.

SUMMARY OF THE INVENTION

It is therefore an object of the present invention to solve the above-mentioned problems by providing for reliable and automatic removal of a parted piece from a punch press.

This and other objects are achieved by providing a punch press, of the type capable of producing a piece from a sheet of material, and the piece being attached to the sheet by a tab, with a separation assembly that fits into a standard tool station. The separation assembly includes a separation punch to sever the tab, thus parting the piece from the sheet. The separation assembly also includes a pressure-plate mechanism that holds a pressure plate against the surface of the sheet and over the parted piece.

The punch press is provided with a positioning carriage to move the sheet of material. When the sheet is moved after the tab is severed, the pressure plate keeps the parted piece and the sheet coplanar, so that the piece is prevented from sliding over or under the sheet. The parted piece can thus be moved, along with the sheet, by the positioning carriage. After deployment of the pressure plate, the sheet is moved by the positioning carriage until the parted piece overlies a drop door. The drop door is then opened, and the piece falls through to be collected for use or scrap.

So that the separation assembly can be used in a standard tool station of a multi-tool punch press, the present invention provides a separately connectable power source for the deployment of the pressure plate. Since the separation assembly is only intermittently used, there is no need for permanent connection to a power source via a rotary union or other complex power connection. When the pressure plate is to be actuated, the control system (preferably a computer-numeric control (CNC) system) of the punch press generates a signal to an actuator to connect the separation assembly to a power supply. Once the parted piece has been removed from the punch press, the actuator disconnects the separation assembly from the power supply, and the pressure plate returns to a retracted position.

These and other objects and advantages will become apparent upon reference to the accompanying description when taken in conjunction with the following drawings.

DESCRIPTION OF THE PREFERRED EMBODIMENT

Figure 1:
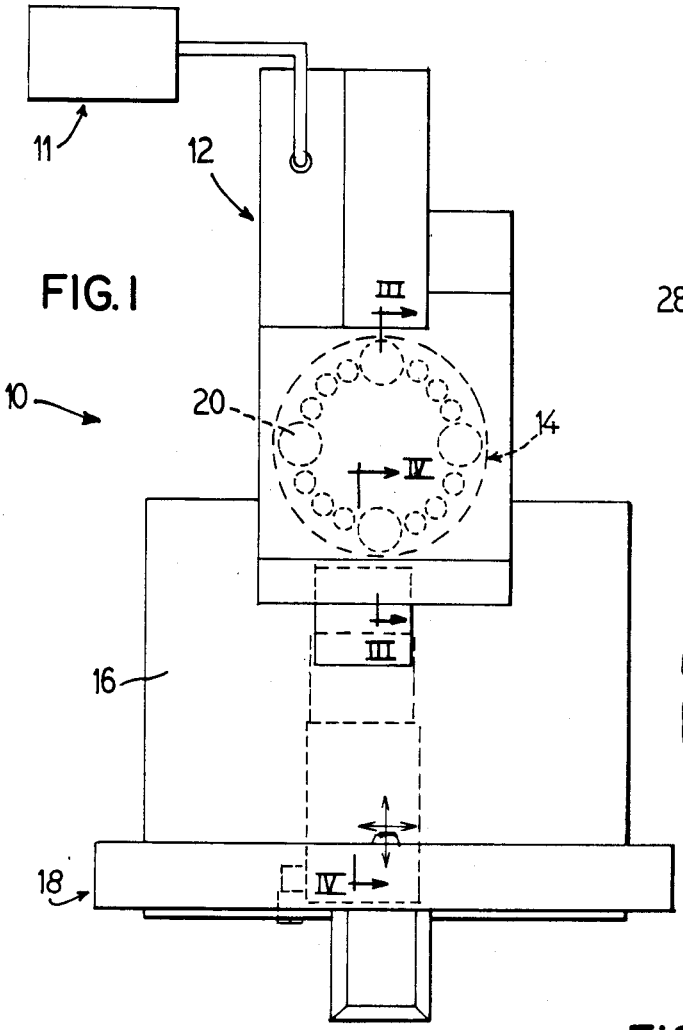
FIG. 1 shows a plan view of a turret punch press embodying features of the present invention.

FIG. 1 shows a turret punch press embodying the present invention. Although the invention is described with reference to a turret punch press, it is to be understood that such description is for illustrative purposes only, and that one of skill in the art will recognize that the present invention may find its utility in other types of punch presses or related apparatus.

Figure 2:
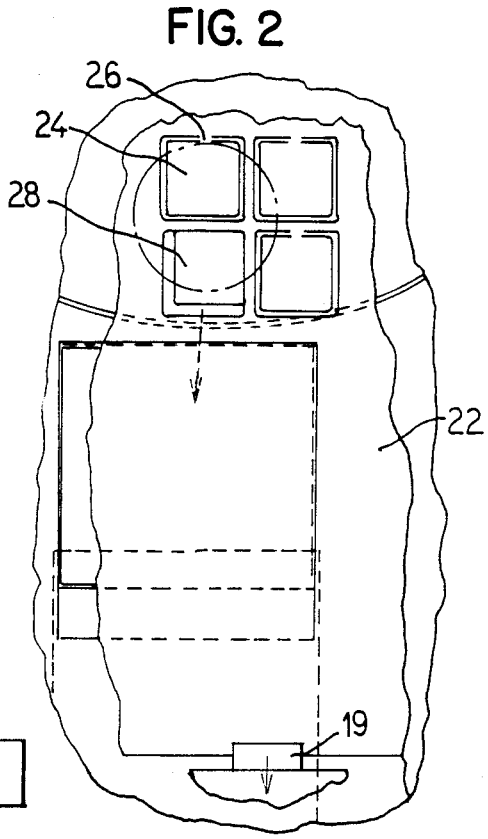
FIG. 2 is a detailed plan view, partially broken-away, of a sheet of material in a punch press.

A turret punch press 10 includes a frame 12 upon which are supported a turret assembly 14, a work table 16 and a positioning carriage 18. The punch press is controlled through a computer-numeric control (CNC) system 11. The turret assembly 14 includes a plurality of tool stations 20, each adapted to receive a respective punch or other tool (not shown). As described in the Background of the Invention, the turret assembly 14 is used to bring respective punches and dies into alignment at a work station, so that a small punch may be used for nibbling a sheet of material, leaving at least one part attached to the sheet by a tab. FIG. 2 shows such a sheet 22 held by a sheet clamp 19 of the positioning carriage 18, with pieces 24 attached to the sheet 22 by tabs 26. One piece 28 is shown parted from the sheet by a process to be described hereinafter.

Figure 5:
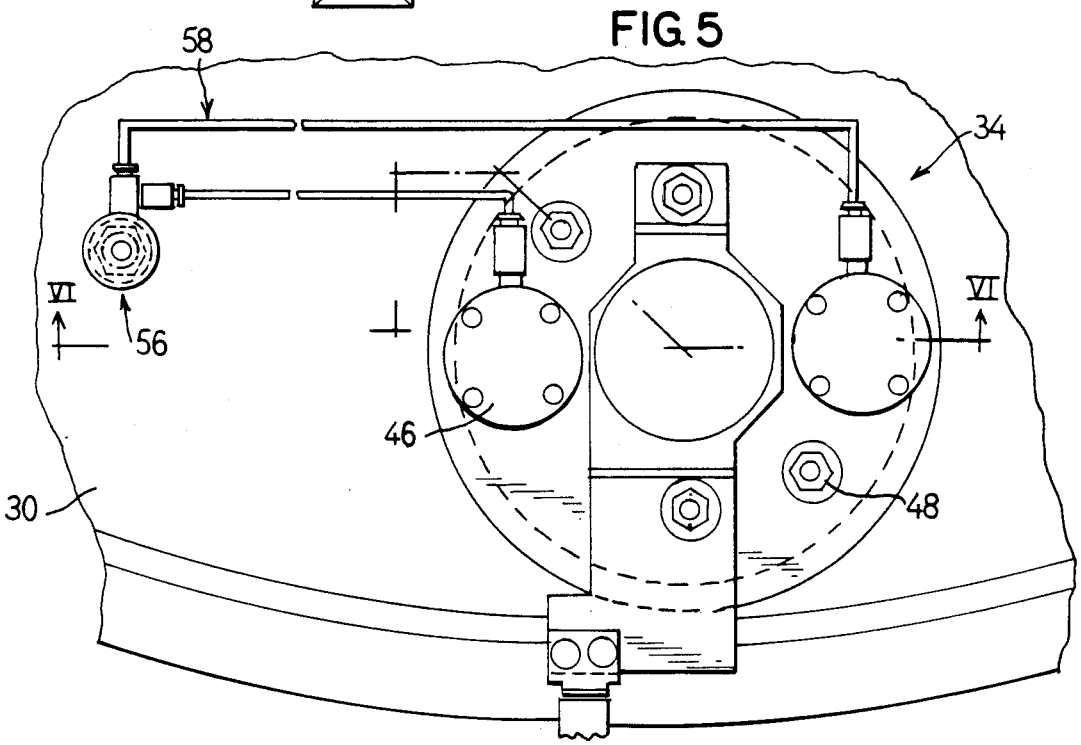
FIG. 5 is a plan view of a separation assembly embodying features of the present invention.
Figure 3:
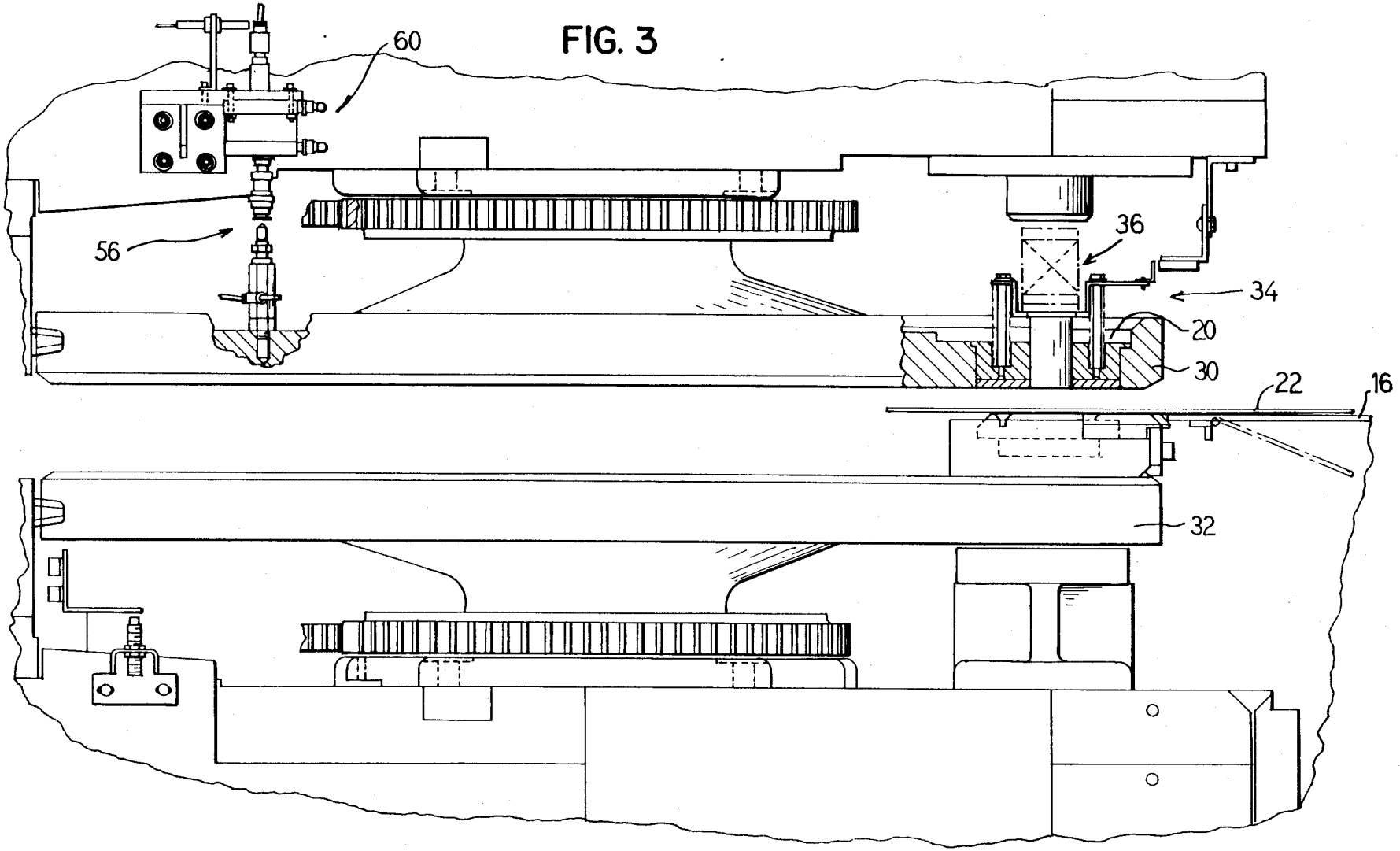
FIG. 3 is a sectional view taken along lines III—III of FIG. 1.
Figure 6:
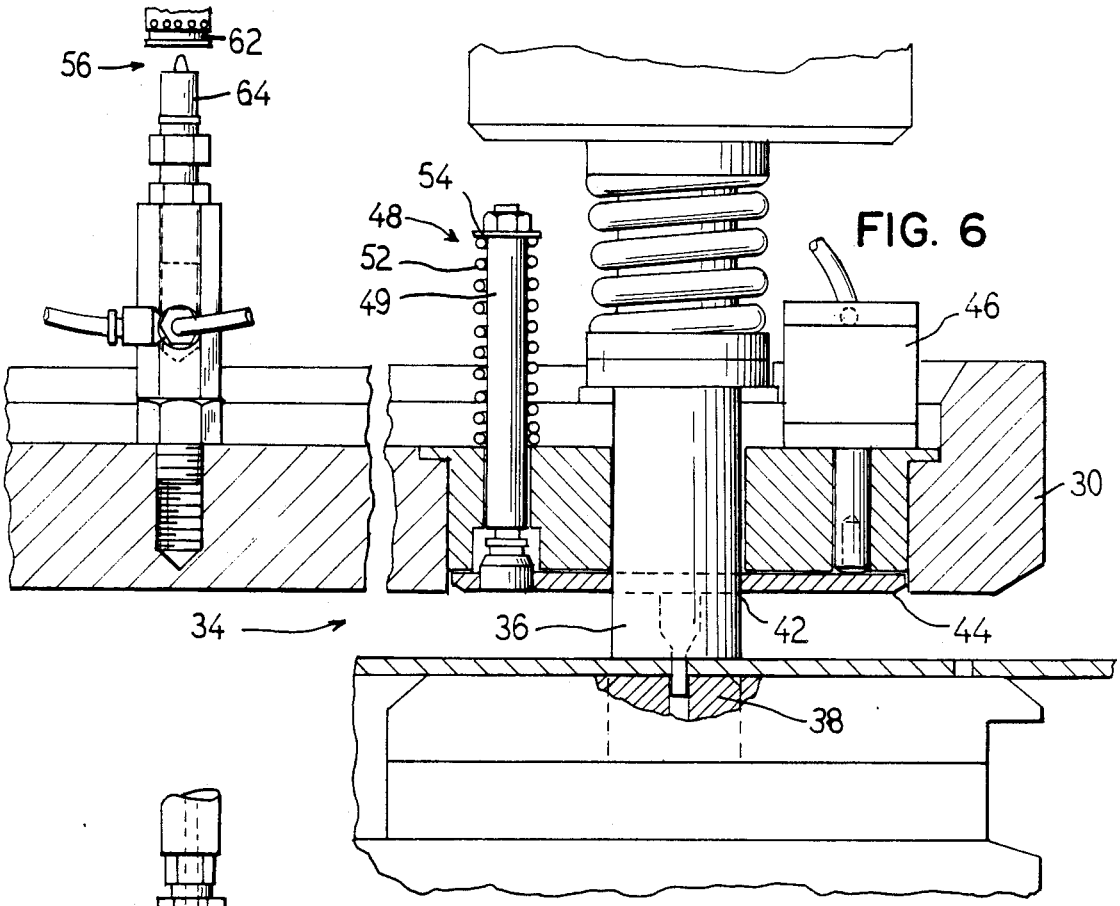
FIG. 6 is a sectional view taken along lines VI—VI of FIG. 5.
Figure 7:
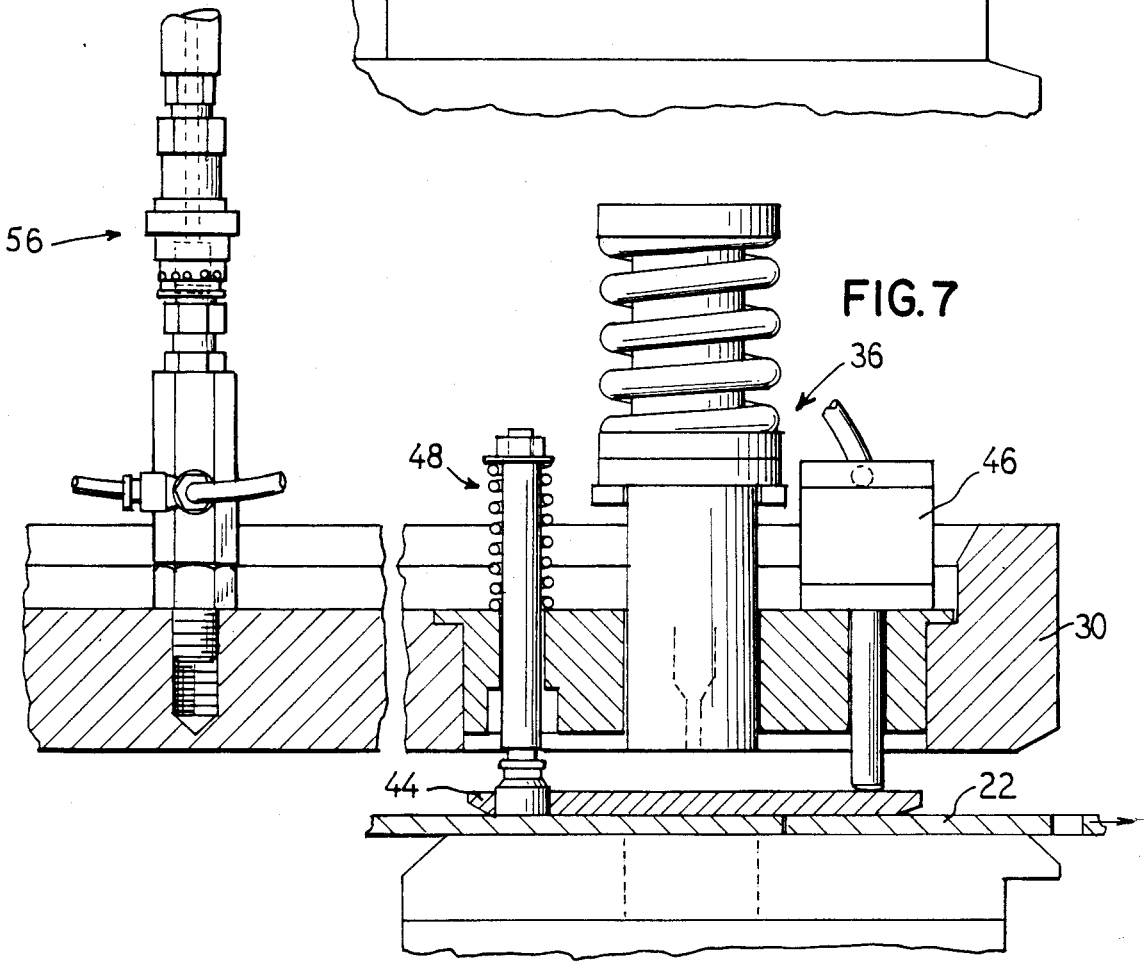
FIG. 7 is a sectional view similar to FIG. 6, but showing the pressure plate in its deployed position.

With particular reference to FIGS. 3, 5 and 6, turret assembly 14 includes an upper turret 30 and a lower turret 32. Mounted on the turret assembly 14 is a separation assembly 34. The separation assembly 34 includes a separation punch 36 and its associated die 38. The separation punch 36 extends through an adapter bush 40 in the tool station 20, and then through an aperture 42 in a pressure plate 44. The pressure plate 44 is vertically movable to engage the sheet 22. The pressure plate 44 is mounted on one-way or single acting cylinders 46 to provide downward movement to a deployed position as shown in FIG. 7. Plate lifters 48 include spring rods 49 which are attached to the pressure plate 44, extend through bores 50 in the upper turret 30, and are biased by compression springs 52 pressing against spring abutments 54 to return the pressure plate 44 to its retracted position, shown in FIG. 6.

Power to the cylinders 46 is provided from a power source (not shown) via a connector 56 through lines 58.

A pneumatic system is shown for the sake of illustration, but it is to be understood that other motive forces (hydraulic, electric, etc.) could be used. The cylinders 46 are actuated by the connection and disconnection of the connector 56. In the illustrated embodiment, a control cylinder 60 is used to engage or disengage the socket 62 and jack 64 of the connector 56.

Figure 4:
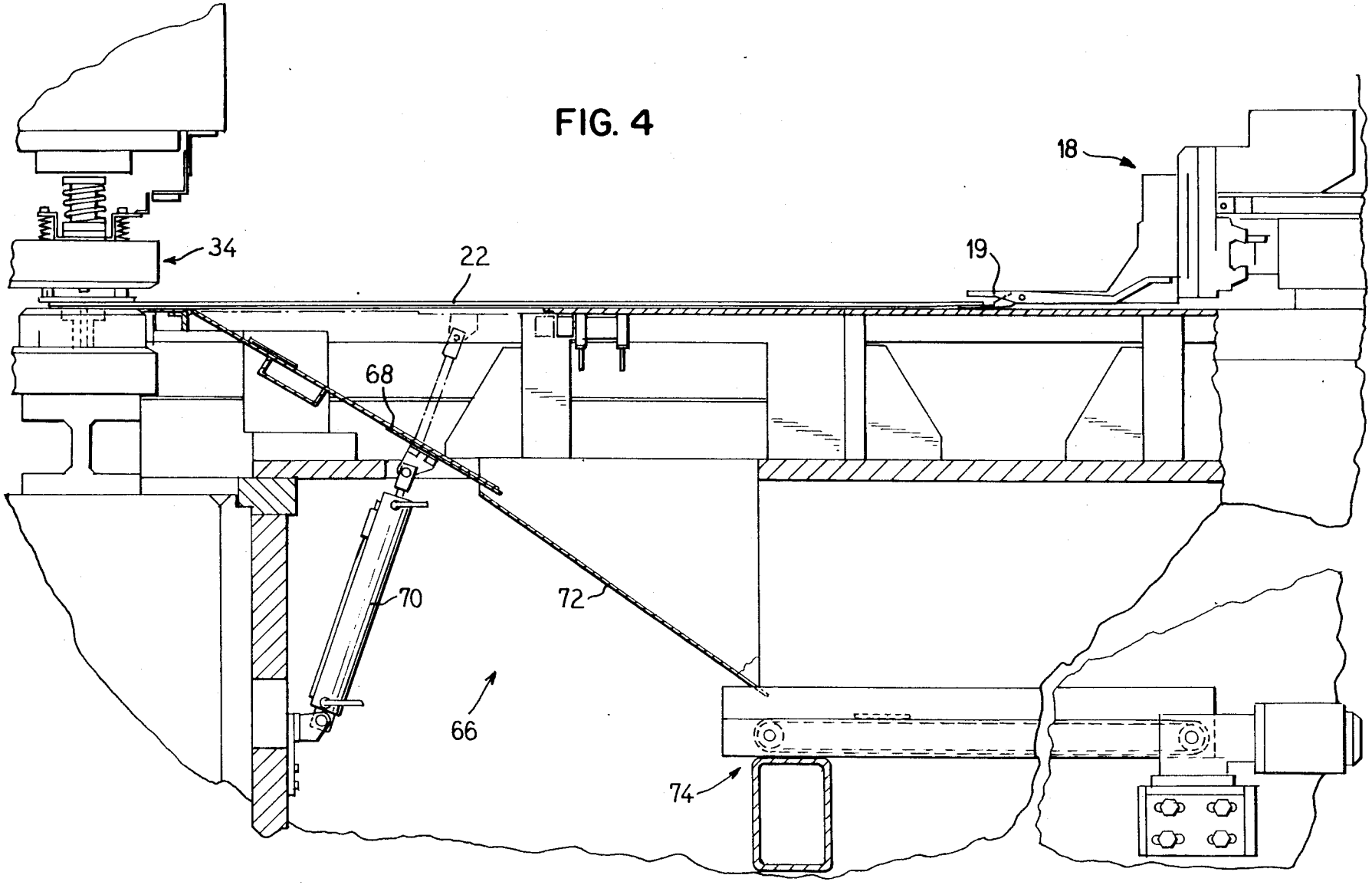
FIG. 4 is a sectional view taken along lines IV—IV of FIG. 1.

A removal assembly 66 of punch press 10 is shown in FIG. 4. The removal assembly includes a hinged drop door 68 operated by a cylinder 70. The drop door 68 leads to a chute 72, which in turn leads to a conveyor 74.

Operation of the above embodiment is as follows. After the punch press has been used to nibble the sheet 22 to form pieces attached by tabs 26, the turret assembly 14 is rotated to bring the separation assembly 34 into its operation position, at the work station and the tab to be severed is positioned under the separation punch 36. The CNC system 11 generates a signal to actuate the separation punch 36 (to the position shown in FIG. 6) to remove the tab, which falls through the die 38. After the tab has been removed, the CNC system 11 generates a signal to the control cylinder 60, which connects the socket 62 to the jack 64 to supply power to the cylinders 46. The cylinders 46 then move the pressure plate 44 into its deployed position (shown in FIG. 7). With the pressure plate 44 deployed, the CNC system 11 signals the positioning carriage 18 to move the sheet 22 until the parted piece overlies the drop door 68. The CNC system 11 then signals the drop door 68 to open, and the parted piece 28 falls through the drop door and slides down the chute 72 to the conveyor 74, which transports the piece to its end destination. As shown in FIG. 2, the parted piece 28 is kept coplanar with the sheet 22, thus allowing the piece to be dragged by the sheet until the piece is over the drop door 68. Once the parted piece has reached the drop door, the connector 56 can be disconnected, allowing the plate lifters 48 to return the pressure plate 44 to its retracted position.

Although the invention has been described with reference to this particular embodiment, those skilled in the art will recognize that various changes may be made therein without departing from the scope and spirit of the invention as set forth in the appended claims.

We claim:

1. A turret punch press of the type capable of producing a piece from a sheet of material, said piece being attached to said sheet by at least one tab, said punch press comprising in combination the following:

upper and lower turrets for selective rotation on a punch press housing, said turrets comprising a plurality of tool stations;

a work table supporting said sheet adjacent said turrets;

a separation assembly disposed in one of said tool stations, said separation assembly including a separation punch and a pressure plate assembly;

a removal assembly including a selectively actuatable drop door in said table beneath said sheet and spaced from said turrets;

positioning means for moving said sheet on said work table;

wherein said separation punch includes means for severing said at least one tab and yielding a parted piece disposed in said sheet; and wherein said pressure plate assembly includes hold-down means for maintaining said parted piece and said sheet in coplanar relation until said positioning means has moved at least a portion of said piece to a position over said drop door.

2. The turret punch press of claim 1, further wherein said hold-down means comprises the following:

a pressure plate;

deployment means for urging said pressure plate into contact with said sheet and said parted piece;

connector means for connecting said deployment means to a power supply;

actuation means for connecting and disconnecting said connector means; and resilient means for returning said plate to a retracted position after disconnection of power to said deployment means.

3. The turret punch press of claim 2, further wherein said power supply is pneumatic, and said deployment means and said actuation means are pneumatic cylinders.

4. The turret punch press of claim 3, further wherein said punch press comprises a computer-numeric control (CNC) system, and said actuation means, said drop door, and said positioning means are operated in response to control signals generated by said CNC system.

5. The turret punch press of claim 4, further wherein said connector means comprises a socket-and-jack connector.

6. The turret punch press of claim 5, further wherein said resilient means in said pressure plate assembly comprises the following:

a pair of spring rods each having first and second ends and passing through respective bores in said upper turret;

the first end of each of said spring rods being affixed to said pressure plate;

a spring abutment secured to the second end of each spring rod; and a pair of compression springs, each coaxially surrounding one of said spring rods and extending between said upper turret and said spring abutments.

7. A turret punch press of the type capable of producing a piece from a sheet of material, said piece being attached to said sheet by at least one tab, said punch press comprising in combination the following:

upper and lower turrets for selective rotation on a punch press housing, said turrets comprising a plurality of tool stations;

separation means for severing said at least one tab and yielding a parted piece disposed in said sheet;

selectively actuatable hold-down means in one of said plurality of tool stations for maintaining said parted piece and said sheet in coplanar relation;

removal means for removing said parted piece from said punch press;

positioning means for moving said sheet and said parted piece; and control means for actuating said hold-down means to maintain said sheet and said parted piece in coplanar relation and simultaneously actuating said positioning means to move said parted piece to said removal means.

8. The punch press or claim 7, further wherein said hold-down means comprises the following:

a pressure plate;

deployment means for urging said pressure plate into contact with said sheet and said parted piece;

connector means for connecting said deployment means to a power supply;

actuation means for connecting said disconnecting said connector means; and resilient means for returning said plate to a retracted position after disconnection of power to said deployment means.

9. The punch press of claim 8, further wherein said power supply is pneumatic, and said deployment means and said actuation means are pneumatic cylinders.

10. The punch press or claim 9, further wherein said removal means comprises a selectively actuatable drop door beneath said sheet.

11. The punch press of claim 10, further wherein said control means comprises a computer-numeric control (CNC) system, and said actuation means, said drop door, and said positioning means are operated in response to control signals generated by said CNC system.

12. The punch press of claim 11, further wherein said connector means comprises a socket-and-jack connector.

13. A method of removing a piece formed in a sheet material by a punch press, including upper and lower turrets said method comprising the following steps:

actuating a turret-mounted separation means for parting said piece from said sheet;

actuating a turret-mounted hold-down means for holding the parted piece and said sheet in coplanar relation;

moving said parted piece and said sheet to a position where said piece overlies a closed drop door; and opening said drop door and permitting said parted piece to fall away from said sheet.

14. The method of claim 13, further wherein said step of actuating a turret-mounted hold-down means includes the following substeps:

providing a pressure plate;

providing deployment means for moving said pressure plate between a hold-down position and a retracted position;

providing a power supply for said hold-down means;

providing a selectively actuatable connector between said power supply and said deployment means; and moving said connector between a connected position supplying power to said deployment means, and a disconnected position cutting off power to said deployment means.

15. A multi-tool punch press having a work station and means to automatically bring tools into alignment at said work station, said tools being capable of at least partially separating a piece from a sheet of material at said work station, said piece being attached to said sheet by at least one tab, said punch press comprising in combination the following:

a work table supporting said sheet adjacent said work station;

a separation assembly adapted to be positioned at said work station, said separation assembly including a separation punch and a pressure plate assembly;

a removal assembly including a selectively actuable drop door in said table beneath said sheet and spaced from said work station;

positioning means for moving said sheet on said work table;

wherein said separation punch includes means for severing said at least one tab and yielding a parted piece disposed in said sheet; and said pressure plate assembly includes hold-down means for maintaining said parted piece and said sheet in coplanar relation until said positioning means has moved said piece to a position over said drop door.

16. A method of forming and removing a piece from a sheet of material at a work station of a multi-tool punch press, said method comprising the following steps:

bringing a punching tool into alignment at said work station;

actuating said punching tool to form a piece of material in said sheet, said piece of material being attached to said sheet by at least one table;

bringing a separation means for parting said piece from said sheet, and a hold-down means for holding the parted piece and said sheet in coplanar relation, into operating position at said work station;

actuating said separation means to part said piece from said sheet, and actuating said hold-down means to hold the parted piece and said sheet in coplanar relation;

moving said parted piece and said sheet to a position where said piece overlies a closed drop door; and opening said drop door and permitting said parted piece to fall away from said sheet.

* * * * *

UNITED STATES PATENT AND TRADEMARK OFFICE

CERTIFICATE OF CORRECTION

PATENT NO. : 4,986,153

DATED : January 22, 1991

INVENTOR(S) : Edgard Matrak and Robert L. Hess

It is certified that error appears in the above—identified patent and that said Letters Patent is hereby corrected as shown below:

Cover page, column 2, line 8, change "Sem" to --Semi--.

column 2, line 9, change "Fabriactor" to --Fabricator--.

Column 6, line 24, change "table" to --tab--.

Signed and Sealed this

Tenth Day of September, 1991

*Attest:*

HARRY F. MANBECK, JR.

*Attesting Officer*

*Commissioner of Patents and Trademarks*